US005105200A

United States Patent [19]

Koepf

[11] Patent Number: 5,105,200

[45] Date of Patent: Apr. 14, 1992

[54] SUPERCONDUCTING ANTENNA SYSTEM

[75] Inventor: Gerhard A. Koepf, Boulder, Colo.

[73] Assignee: Ball Corporation, Muncie, Ind.

[21] Appl. No.: 539,497

[22] Filed: Jun. 18, 1990

[51] Int. Cl.[5] ..... H01Q 1/380; H01Q 21/000; H01P 3/008; H01P 1/000

[52] U.S. Cl. ..... 343/700 MS; 333/99 S; 333/101; 333/246; 333/263; 343/853; 505/851

[58] Field of Search ..... 505/842, 843, 860, 866, 505/851, 856, 861, 862; 343/700 MS, 853, 852; 333/101, 104, 128, 164, 995, 246, 263

[56] References Cited

U.S. PATENT DOCUMENTS

| | | | |
|---|---|---|---|
| H,000,653 | 7/1989 | Conrad | 343/792 |
| 3,090,023 | 5/1963 | Brennemann et al. | 505/862 |
| 3,174,124 | 3/1965 | Bremer | 505/862 |
| 3,512,017 | 5/1970 | Pierce et al. | 505/862 |
| 4,490,721 | 12/1984 | Stockton et al. | 343/700 MS |
| 4,876,239 | 10/1989 | Cachier | 333/99 S |

FOREIGN PATENT DOCUMENTS

| | | | |
|---|---|---|---|
| 0017503 | 1/1989 | Japan | 343/700 MS |

OTHER PUBLICATIONS

Hansen, Superconducting Antennas, IEEE Transactions on Aerospace and Electronic Systems, vol. 26, No. 2, Mar. 1990, pp. 345-355.

*Primary Examiner*—Rolf Hille
*Assistant Examiner*—Peter Toby Brown
*Attorney, Agent, or Firm*—Gilbert E. Alberding

[57] ABSTRACT

A superconductive array antenna system provides a substantial improvement of gain, in the range of from about 5 db to over 20 db, at frequencies in excess of 20 gigahertz, and preferably in the range from 40 to 100 gigahertz and beyond. The antenna system includes a phased antenna array, operating at superconductive cryogenic temperatures, with superconductive phasing and switching systems, to permit antenna beam steering and polarization independent of operating frequencies. The invention also permits the elimination of amplifiers and other such elements that have been needed to overcome system losses, and permits further miniaturization of such systems.

13 Claims, 5 Drawing Sheets

SUPERCONDUCTING ANTENNA SYSTEM

FIELD OF THE INVENTION

This invention relates to antenna systems, particularly antenna systems adapted to operate in the microwave and micro-microwave regimes and more particularly to high-gain phased antenna arrays operating from above 20 to beyond 100 gigahertz.

BACKGROUND ART

Superconductivity is a well known phenomenon. For some time superconductivity has been considered as possibly beneficial in the various elements of microwave systems by permitting a substantial reduction of the ohmic resistance of such elements. With the discovery of availability of high temperature superconductive materials, workers in the field have assembled and tested various microwave devices to determine the extent to which superconductive elements may improve the performance of various microwave devices.

For example, Robert J. Dinger and David J. White of the Naval Weapons Center, in *Theoretical Increase in Radiation Efficiency of Small Dipole Antenna Made with a High Temperature Superconductor,* have reported a theoretical investigation of an electrically small dipole antenna with a shunted stub impedance matching network to determine the improvement in radiation efficiency that can be achieved by making the metallic components of high temperature superconducting materials. Their study was based on the discovery of Y-Ba-Cu-O ceramic materials that are superconducting at high enough temperatures to permit efficient cooling of relatively large antenna structures. The study considered dipoles with lengths up to 0.4 wavelengths and determined antenna input impedance for such dipoles as a function of radiation resistance, antenna element conductor loss and antenna reactance. Their study indicated that efficiency improved, as expected, as the surface resistance of the antenna elements was reduced, but that antenna efficiency leveled off when dielectric losses began to dominate, and that unless a dielectric loss tangent of less than $10^{-4}$ can be obtained, only a modest improvement of radiation efficiency can be obtained, and, in addition, even a dielectric loss tangent as low as $10^{-4}$ limits the high efficiency region to antenna elements with lengths of 0.2 wavelengths or higher. Messrs. Dinger and White concluded that the antenna and all supporting and matching structures must use very low loss dielectric materials to realize enhanced efficiency through superconductivity, that large standing waves will produce most of the system loss if low loss materials are not used, and that antenna ohmic losses may actually be only the smallest fraction of system losses. Dinger and White, therefore, suggested that dielectric materials should be avoided by using air dielectric lines and self-supporting antenna structures, but recognized that the high temperature superconductive materials have low thermal conductivities and will require heat transfer media of some type, and that these conflicting requirements complicated the design of practical superconductive, electrically-small antennas.

Raymond W. Conrad, in U.S. Statutory Invention Registration H653 published Jul. 4, 1989, disclosed a superconducting, superdirective array of half-wave dipoles constructed of various superconductive materials, including high temperature superconductive materials. Conrad's array comprised a plurality of half wave dipoles stacked with spacings of less than one-half wavelength of the emission frequency of the dipoles. The array was housed in a vacuum insulated container for the antenna array and the coolant, which is closed at one end by a microwave window for electromagnetic radiation. Conrad indicated the antenna elements must be made of a material with a high critical current and high critical magnetic field for maximum efficiency and further indicated that exceeding the critical current of the antenna element material will produce a return to normal conductivity and high ohmic losses which can damage the antenna element material.

Personnel of AT&T Laboratories have reported experiments with a 31 centimeter long, high temperature, superconducting, thin film microstrip transmission line comprised of a Y-Ba-Cu-O ground plane and microstrip line, both about 4000A thick, on lanthanate gallate substrates, separated by a sapphire dielectric. The microstrip pattern was a coiled serpentine arrangement with a line 125 micrometers wide and spaced 375 micrometers from adjacent coils. The sapphire dielectric was 125 micrometers thick providing a nominal line impedance of 50 ohms. Testing of the dc resistance of the line indicated a high quality film with a sharp transition to superconductivity at about 85° K. The test results indicated little variation in signal delay and reflected wave shape at temperatures less than the critical temperature and that there are no basic changes in the basic characteristics of the transmission line at temperatures well below the critical temperature and currents below the critical current. See Experiments with a 31-CM High-Tc Superconducting Thin Film Transmission Line.

Lincoln Laboratory personnel used the discovery of high-temperature, superconducting materials to study stripline resonators and their use to stabilize oscillators operating in the 1 to 10 GHz range. The detection of small targets in clutter by doppler radar systems is currently limited by phase noise in the local oscillator, and a 10–20 db reduction in noise would provide a corresponding increase in sensitivity. Lincoln Laboratory personnel selected stripline techniques over microstrip techniques to eliminate radiation, permit planar fabrication techniques and provide a compact and rugged structure, and used the stripline resonator to study the surface temperature effects of the high temperature superconductive materials. As a result of their study, the Lincoln Laboratory personnel concluded that projected noise performance of stripline resonators with high temperature superconductors was better than competing technologies but was limited by flicker noise which may be due to the quality of the superconductive film.

Reissue U.S. Pat. No. 29,911 discloses a microstrip antenna structure that is formed from a unitary conducting surface separated from a ground plane by a dielectric substrate and providing radiating elements and feed lines. The disclosed antenna structure includes the provision of phased antenna arrays with high gains in the microwave region and phase shifting circuits obtained by using printed circuit techniques on a planar substrate.

Reissue U.S. Pat. No. 32,369 discloses an antenna system formed on a gallium arsenide semiconducting substrate with, where appropriate, feed networks, phasing networks, active or inactive semiconductor devices and microprocessor controllers. The gallium arsenidebase antenna system provides direct radiation and receiving elements and the phase-shifting, amplifying and controlling elements that can provide high gain phased arrays. In these systems microstrip radiators are provided by metallization adjacent a semiconductive material.

These reports and disclosures exemplify the extensive efforts to improve microwave system and antenna arrays.

DISCLOSURE OF THE INVENTION

This invention provides a superconductive antenna system with a substantial improvement of gain, in the range of from about 5 db to over 20 db, at frequencies in excess of 20 gigahertz, and preferably in the range from 40 to 100 gigahertz and beyond. The antenna system of the invention provides a phased antenna array, operating at superconductive cryogenic temperatures, with superconductive phasing and switching systems, to permit antenna beam and polarization steering independent of operating frequencies. The invention also permits the elimination of amplifiers and other such elements that have been needed to overcome system losses, and permits further miniaturization of such systems.

An antenna of the invention includes a dielectric substrate, a planar layer of superconductive material on one surface of said dielectric substrate patterned in the form of at least one, and preferably a plurality of, microwave antenna elements, connected to an antenna input port through a microwave feed network, and a planar layer of superconductive material formed on the other surface of said dielectric substrate. The invention further includes a variable microwave network that includes a conductor array formed of superconductive materials on one side of a dielectric substrate, which may include a plurality of delay line portions interconnected by a plurality of interconnecting conductor portions, a ground plane for said conductor array formed of superconductive materials on the other side of said dielectric substrate to provide, with said conductor array, a microwave network, one or more superconductive switching means located at one or more locations on the conductor array, and means to operate the one or more superconductive switching means by raising the temperatures of one or more of portions of the conductor array above the critical temperature of the superconductive material and thereby varying the microwave network, for example, by selecting specific delay line portions and providing a variable microwave delay. In the preferred embodiments of the invention, the variable microwave delay network is formed on the same dielectric substrate as the antenna system, preferably with the same superconductive material.

Antenna systems of the invention can thus include an array of superconductive antenna elements interconnected by a superconductive microwave network, which may include delay line portions, provided with a plurality of superconductive switching means that can be operated to provide variable phasing and directivity. In addition, an antenna system of the invention may be provided with one or more antenna elements and means to transition selected portions of the one or more antenna elements from the superconducting material state to the normal conducting material state to thereby change its effective dimensions as an antenna element and provide radiation of microwave energy under another set of conditions. Exercising such a transition from the superconducting material state to the normal conducting material state can be achieved by means of exceeding the critical temperature, the critical current, the critical magnetic field, or a critical photon flux of the material in the said portion of the antenna element.

Antenna apparatus of this invention includes means to reduce the temperature of the superconductive materials forming components on the dielectric substrate below the critical temperatures and provides an antenna system with one or more microwave antenna elements, and an interconnecting microwave network with one or more variable antenna element interconnecting means, all operating in superconductivity. Superconducting operating temperatures can be provided by a cryogenic container refrigerated by a closed cycle cryogenic refrigerator, a stored cryogen, or in space, a heat sink.

Other features and advantages of the invention will be apparent from the drawings and description of the best mode of the invention below.

BEST MODE OF THE INVENTION

Figure 1:
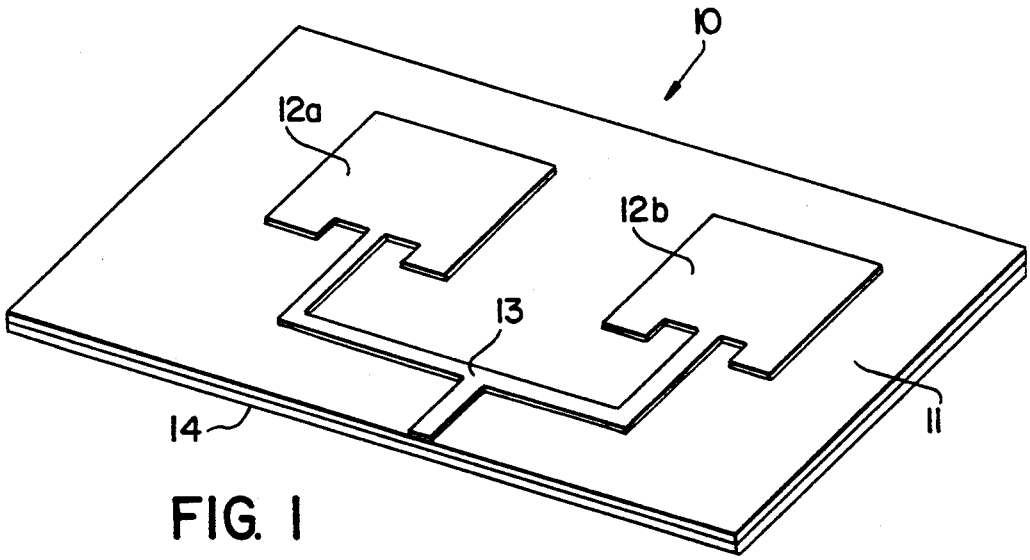
FIG. 1 is a perspective view of a superconductive antenna of this invention.

FIG. 1 is a drawing of an antenna 10 of this invention. As shown in FIG. 1, an antenna of this invention includes a dielectric substrate 11, a planar layer of superconductive material formed on one surface of the dielectric substrate 11 in the form of at least one microwave antenna element, and preferably, as shown, a plurality of microwave antenna elements 12*a*, 12*b*. The one or more microwave antenna elements are provided with connection means through a microwave feed network 13. The antenna 10 also includes a planar layer 14 of superconductive material formed on the other surface of the dielectric substrate. Preferably the antenna elements 12*a*, 12*b* and microwave feed network 13 are formed as shown in FIG. 1 on the same dielectric substrate and preferably by the same superconductive material.

As is apparent to those skilled in the art, the antenna 10 provides a microstrip antenna including one or more radiating patches 12*a*, 12*b* and a microwave stripline connection means 13 in combination with the ground plane 14. The radiating antenna elements 12*a*, 12*b*, their arrangement into arrays to provide phased array antenna systems, and their shape may be determined by those skilled in the art, using known microwave design criteria, based upon a desired operating wavelength, the dielectric constant and thickness of substrate 11 and operating band width and polarization criteria. An example of a text setting forth such design criteria is "Microstrip Antennas" by J. Bahl, and P. Bhartia, Artech House, Inc., 1982, Library of Congress No. 80-70174 and other similar texts. The dimensions and arrangements of the microwave feed network 13 may also be determined by known microstrip waveguide design criteria. The superconductive materials forming the one or more antenna elements 12*a*, 12*b*, microwave feed network 13 and ground plane 14 are preferably high-temperature superconducting materials, which include any of the new superconducting materials being developed with critical temperature values above 77° K. Such known superconductive materials presently include ceramic oxides such as Y-Ba-Cu-O, Er-Ba-Cu-O, and various thallium and bismuth based materials.

Such dielectric substances include the rare earth gallates and aluminates, sapphire, magnesium oxide, and semiconductors like silicon and gallium arsenide, and include also layered compositions of such materials. In addition, the substrate material 11 can also be a ferrimagnetic material such as the rare earth orthoferrites.

The incorporation of such superconductive antenna elements and microwave feed networks can provide significant advantages in phased array antennas. At frequencies of 10 GHz and higher, non-superconductive antenna components such as the antenna radiating elements, phase shifters and feed networks, provide losses that are unacceptable in many radar, radiometric and communication systems. Amplifiers are frequently included in the radiating element signal paths to compensate for such losses, and this substantially increases the cost and complexity of such phased array antenna systems. Antenna systems of the invention in which the radiating antenna elements and interconnecting feed network, including any desired phase shifters, are formed by lossless superconductive thin films substantially reducing the complexity and number of components required in phased array antennas. In addition, the extremely low losses of the superconductive components of such antenna systems allow miniaturization of the circuits by reducing conductor widths to a few microns. The impedance of such narrow microstrip lines can be maintained in the 50–100 ohm range by thinning the substrate. An example of such a superconductive phased array system is shown in FIG. 3, described below.

Figure 2:
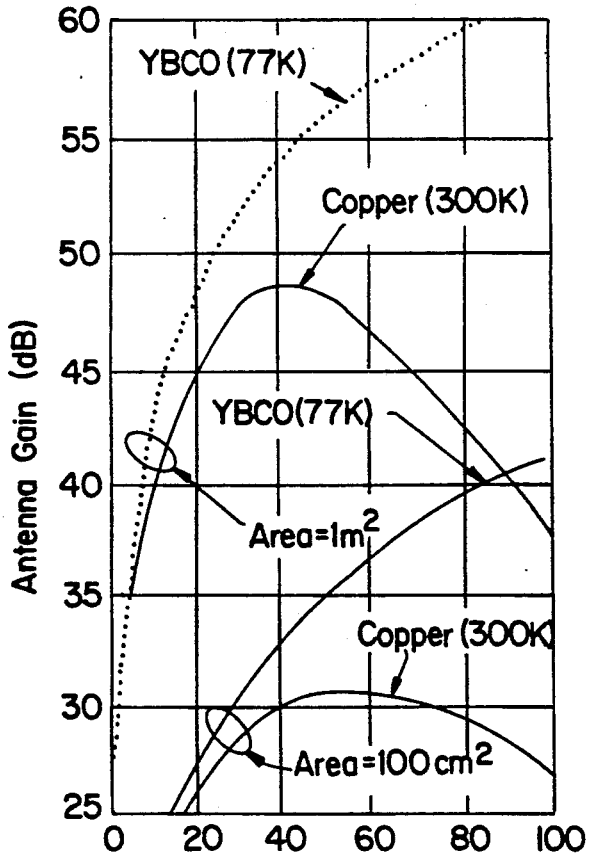
FIG. 2 is a graph comparing the performance of an antenna system of this invention with a comparable non-superconductive antenna system.

FIG. 2 is a graph showing the antenna gain advantage of this invention at frequencies greater than 10 GHz. As noted from FIG. 2, substantial gain advantages begin to be realized at about 20–25 GHz, and unlike non-superconductive antennas, the antenna gain continues to increase rather than decline at frequencies in excess of 50–60 GHz and beyond 100 GHz. Thus, the invention permits efficient low-loss microstrip antenna systems at frequencies substantially in excess of 20–25 GHz, and preferably in the operating range from 40 to beyond 100 GHz.

Figure 3:
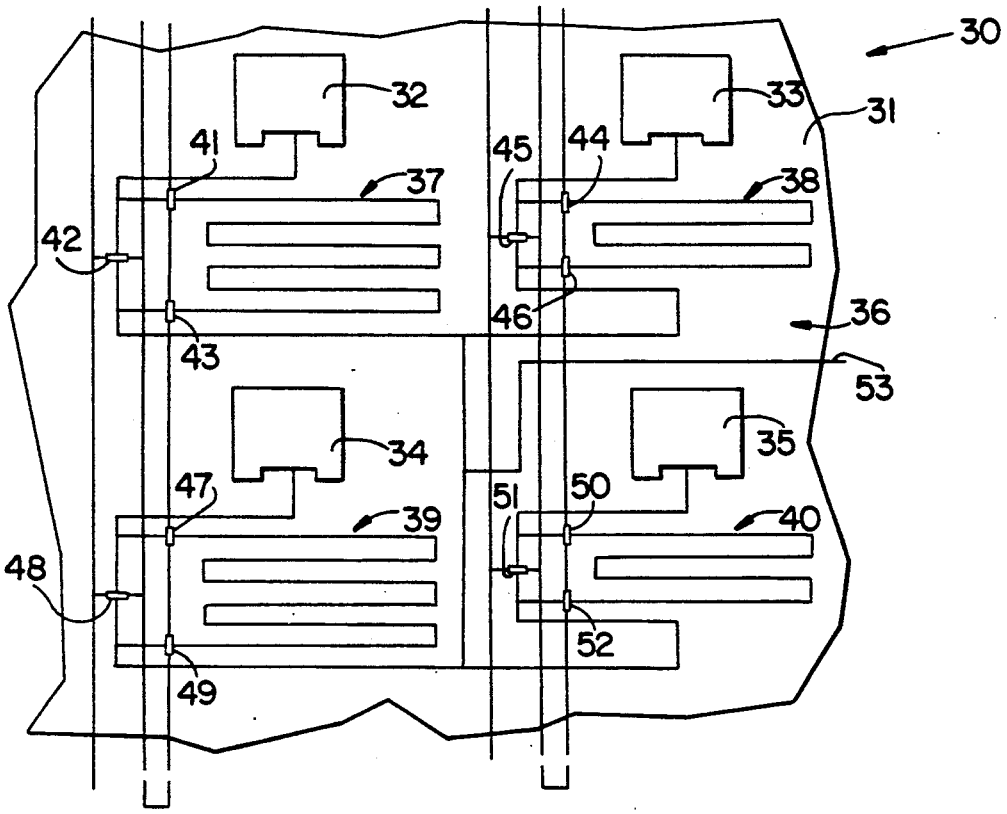
FIG. 3 is a diagrammatic drawing of superconductive array antenna system of this invention.

FIG. 3 shows a phased array antenna system 30 of this invention. FIG. 3 is a plan view indicating a pattern of superconductive material formed on one side of a dielectric substrate 31. It will be understood that a superconductive ground plane, which is not shown in FIG. 3, is formed on he opposite side of the dielectric substrate 31. As shown in FIG. 3, such a phased array antenna system of this invention includes a plurality of radiating antenna elements 32, 33, 34 and 35. Antenna elements 32, 33, 34 and 35 are connected through a microwave feed network 36 to an antenna input port 53. As shown in FIG. 3, microwave feed network 36 is formed on the dielectric substrate 31 by a pattern of superconductive material and may include a plurality of delay lines 37, 38, 39 and 40, which may be placed in series with radiating elements 32, 33, 34 and 35 by superconductive switches 41–52 of a type described below. By operation of various combinations of the superconductive switches 41–52, microwave energy delivered to the antenna system 30 over the input port 53 may be variously delayed in its application to different ones of the radiating antenna elements 32–35 or to different combinations of the radiating antenna elements 32–35 to introduce real time delay and to provide true time delay beam control, that is, the steering of antenna beams independent of operating frequency. Thus, in this invention, with superconductive materials, delay lines can be implemented on the same surface as the antenna radiating elements and feed network. The input insertion loss of such antenna systems is determined by the effect of high impedance terminations of the off-state delay line sections.

The operation of such phased array antenna systems to provide true time delay beam steering can be understood by referring to the top portion of FIG. 3, including antenna element 32, delay line 37 and superconductive switching means 41, 42 and 43. If superconductive switching means 41 and 43 provide high impedance, interrupting the flow of microwave energy through delay line 37, and switch 42 permits a low impedance path for microwave energy between feed 53 and antenna element 32, and if superconductive switching means 44 and 46 are operated to provide a high impedance, interrupting the flow the microwave energy through delay line 38, and superconductive switching means 45 permits a low impedance path between feed 53 and antenna element 33, there is no significant time delay (or phase difference) in the microwave radiation from antenna elements 32 and 33. If, on the other hand, superconductive switching means 42 is operated to provide a high impedance between feed 53 and antenna element 32 and superconductive switching means 41 and 43 are operated so that there is no high impedance interruption of the flow of microwave energy from feed 53 through delay line 37 to antenna element 32, the microwave radiation from antenna element 32 is delayed by the delay time of delay line 37, and the antenna system can thus be provided with a true time delay between the electromagnetic energy radiated from antenna element 32 and that radiated from antenna element 33 if superconductive switching elements 44–46 remain in the state previously described above. It will thus be apparent that by the selective use of superconductive switches 41–43, 44–46, 47–49 and 50–52, the time delays of delay lines 37, 38, 39 and 40, respectively, may be selectively introduced into the flow of microwave energy from antenna elements 32, 33, 34 and 35, respectively, in any combination. In addition, although FIG. 3 shows a phased array antenna system of this invention with a single delay line in series with each antenna element, the microwave feed network 36 may be provided with a pattern of superconductive material and superconductive switching elements to provide multiple delay lines and multiple time delays for series connection with each of the antenna elements.

Figure 4:
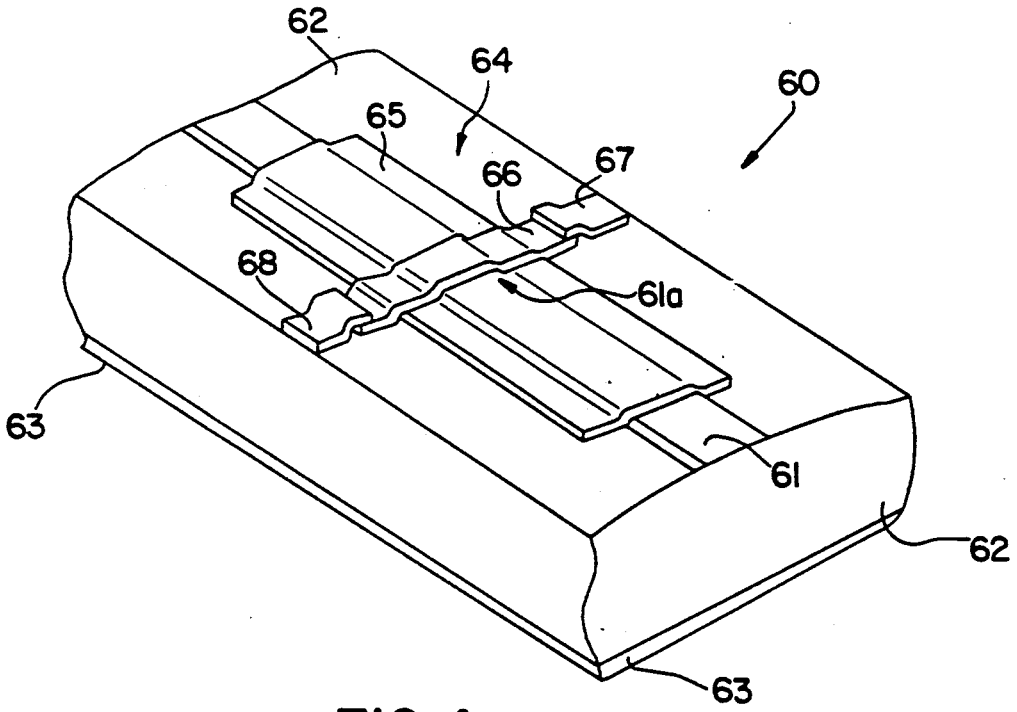
FIG. 4 is a perspective view of a superconductive switch means of the invention.

FIG. 4 shows in greater detail a superconductive microstrip switch which is, for example, incorporated as the superconductive switching means 41–52 of the array antenna 30 of FIG. 3. In the shown embodiment of such a superconducting microstrip switch, a transition from the superconducting material state to the normal conducting material state is exercised by a change in the temperature of a portion of the microstrip line, thus realizing a change in the impedance of the microstrip line and thereby inhibiting the low loss propagation of microwave energy through the microstrip line. As shown in FIG. 4, such a superconductive microstrip switch 60 can comprise a conductor 61 formed of superconductive material, and preferably high temperature superconductive material, on a dielectric substrate 62. Such a conductor 61 in conjunction with a superconductive ground plane 63 formed on the other side of the dielectric substrate 62 can comprise a superconductive microstrip line for microwave energy. The superconductive microstrip switch 60 is operated by means 64 in heat transfer relationship with a portion 61*a* of the conductor 61 formed of superconductive material and adapted to raise the temperature of a portion of the conductor 61 above the critical temperature of the superconductive material. As shown in FIG. 4, the means 64 in heat transfer relationship with the conductor comprises a dielectric layer 65 overlying the conductor 61 of superconductive material, a resistive heating means 66 in heat transfer relationship with the conductor 61 of superconductive material through said thin dielectric layer 65 and connections 67 and 68 for a supply of electric current to the resistive heating means 66. In operation of the superconductive microstrip switch, electric current may be supplied through metal contacts 67 and 68 to the resistive layer 66 to raise the temperature of the resistive layer 66 sufficiently that heat conducted through the thin dielectric layer 65 increases the temperature of portion of the conductor 61 above its critical temperature, providing a substantial increase in impedance in the microstrip line at the location of superconductive switch means 60 substantially impeding the transfer of microwave energy over the superconductive microstrip line 61.

The invention thus provides a variable microwave delay network that can be incorporated into phased array antennas, including a conductor array formed of high temperature superconductive materials on one side of a dielectric substrate (such as the microwave feed network 36 shown in FIG. 3 on substrate 31), including one or more delay line portions (such as the delay line portions 37, 38, 39 and 40 incorporated into the microwave feed network 36 of FIG. 3) and superconductive interconnecting conductors. As shown in FIG. 3, in such a variable microwave delay network, such delay line portions can be interconnected by a plurality of interconnecting superconductive portions and a plurality of superconductive switching means (such as the superconductive switches 41–52) located at a plurality of locations on the interconnecting superconductive portions. The superconductive switching means, which may be of the type shown in FIG. 4, may be operated by means to raise the temperatures of various superconductive interconnecting conductor portions above the critical temperature of the high temperature superconductive material and thereby insert specific delay line portions into the microwave feed network and provide variable microwave delays. In such variable microwave delay networks, each of the plurality of delay line portions is preferably bypassed by a short conductor portion. In such a variable microwave delay network, any time delay may be selected and designed into the delay line portions and switched into or out of the network by superconductive switches.

Figure 5:
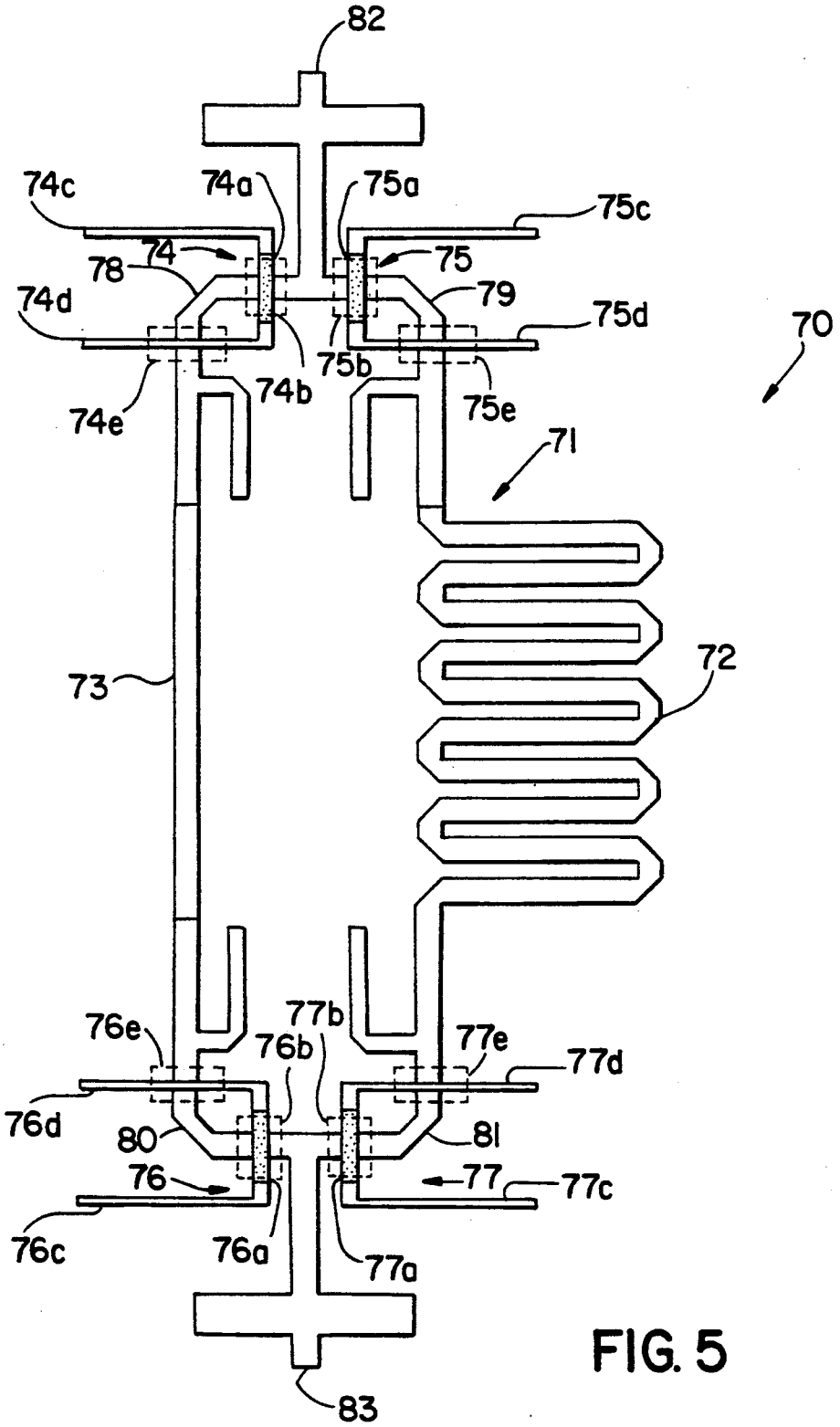
FIG. 5 is a diagrammatic drawing of a variable microwave network of this invention.

FIG. 5 shows one such variable delay network 70 of this invention. Variable microwave delay network 70 comprises a conductor array 71 formed of high temperature superconductive material on one side of a dielectric substrate. As shown in FIG. 5, the conductor array forms a delay portion 72 and a bypass portion 73. A plurality of superconductive switching means 74, 75, 76 and 77 are located at a plurality of interconnecting conductor portions 78, 79, 80 and 81, respectively. Although not shown in FIG. 5, it is to be understood that the dielectric substrate on which the conductor array 71 is formed includes, on its opposite surface, a ground plane formed of high temperature superconductive material. As set forth above and shown in FIG. 4, each of the superconductive switches 74, 75, 76 and 77 includes a thin film resistor 74*a*, 75*a*, 76*a* and 77*a* located in heat transfer relationship with one of the plurality of interconnecting conductor portions 78, 79, 80 and 81, respectively. Between each of the thin film resistive means 74*a*–77*a* and the associated interconnecting conductor portions 78–81 is a thin dielectric layer 74*b*–77*b*, respectively. Each of the superconductive switching means 74–77 may be operated by electric current provided to their respective connections 74*c*–77*c* and 74*d*–77*d* to heat the thin film resistors 74*a*–77*a* and to raise the temperature of the one or more interconnecting conductor portions 78–81 above the critical temperature of the high temperature superconductive material. For example, if superconductive switches 74 and 76 are operated by applying electric current to their respective terminal 74*c*, 74*d* and 76*c*, 76*d* to raise the temperature of the interconnecting conducting portions 78 and 80 above their critical temperatures, while superconductive switches 75 and 77 are inactive, microwave energy travelling between terminals 82 and 83 is directed through delay portion 72. With the activation, however, of switches 75 and 77 to raise the temperature of conductor portions 79 and 81 above their critical temperature, microwave energy flowing between terminals 82 and 83 is directed through the delay line bypassing portion 73. As shown on FIG. 5, the connections 74*d*, 75*d*, 76*d* and 77*d*, respectively, are isolated from the conductor array 71 by dielectric layers 74*e*–77*e*, respectively.

Figure 6:
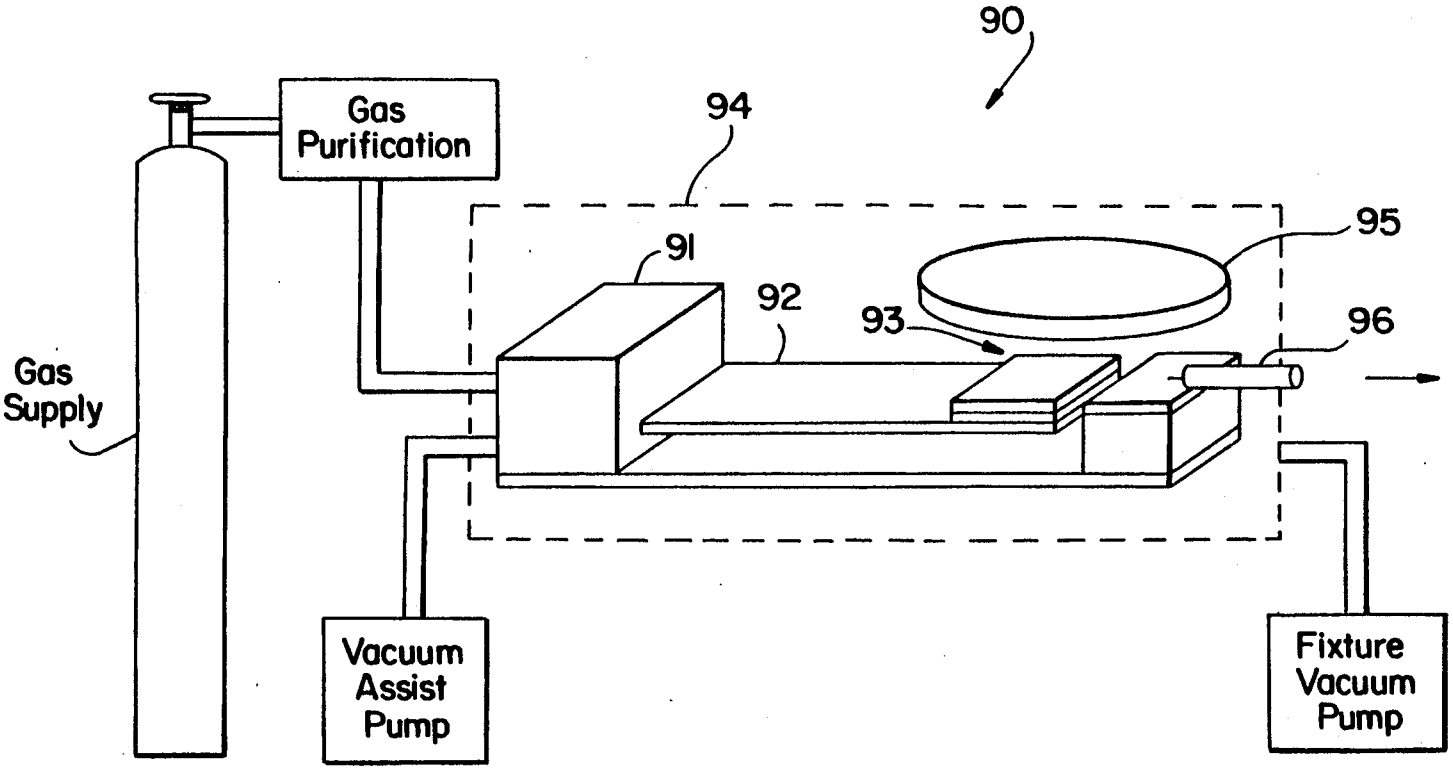
FIG. 6 is a diagrammatic drawing of an antenna apparatus of this invention.

An antenna apparatus 90 of the invention including one cooling means is shown in FIG. 6. The apparatus 90 of FIG. 6 includes cryogenic refrigeration unit 91 and a heat transfer means 92 to reduce the temperature of the superconductive components of an antenna system 93 below the critical temperature of the superconductive material from which they are formed. The antenna system 93, cryogenic refrigeration unit 91 and heat transfer means 92 are all contained within a cryogenic container indicated at dashed lines 94. Container 94 may be provided with "super insulation" as is well known in the art to thermally insulate components 91–93 of the apparatus 90 so that they may be efficiently maintained at cryogenic temperatures below the critical temperature of high temperature superconductive material. The cryogenic container 94 of the apparatus 90 may be provided with a radio frequency window 95, as indicated on FIG. 6. The container 94 also includes a means 96 for RF coupling between the antenna input port and the transmitter and/or receiver outside the container 94.

In addition to apparatus including cryogenic refrigeration systems, antenna systems of the invention may be contained within closed containers adapted to maintain a cryogen and the antenna system below the critical temperature of the superconductive materials. In such systems, a superconductive antenna system may be maintained at temperatures below the critical temperature of its superconductive materials through a conductive heat transfer means in contact with the cryogen. Such cryogenic containers for the antenna systems are provided with an RF window for the transmission of microwave energy from the antenna system. In addition, the cryogenic containers for such antenna systems may be adapted at their outer surfaces to reflect radiant heat energy and are preferably evacuated to prevent convective heat transfer from the antenna system to its surroundings.

Figure 7:
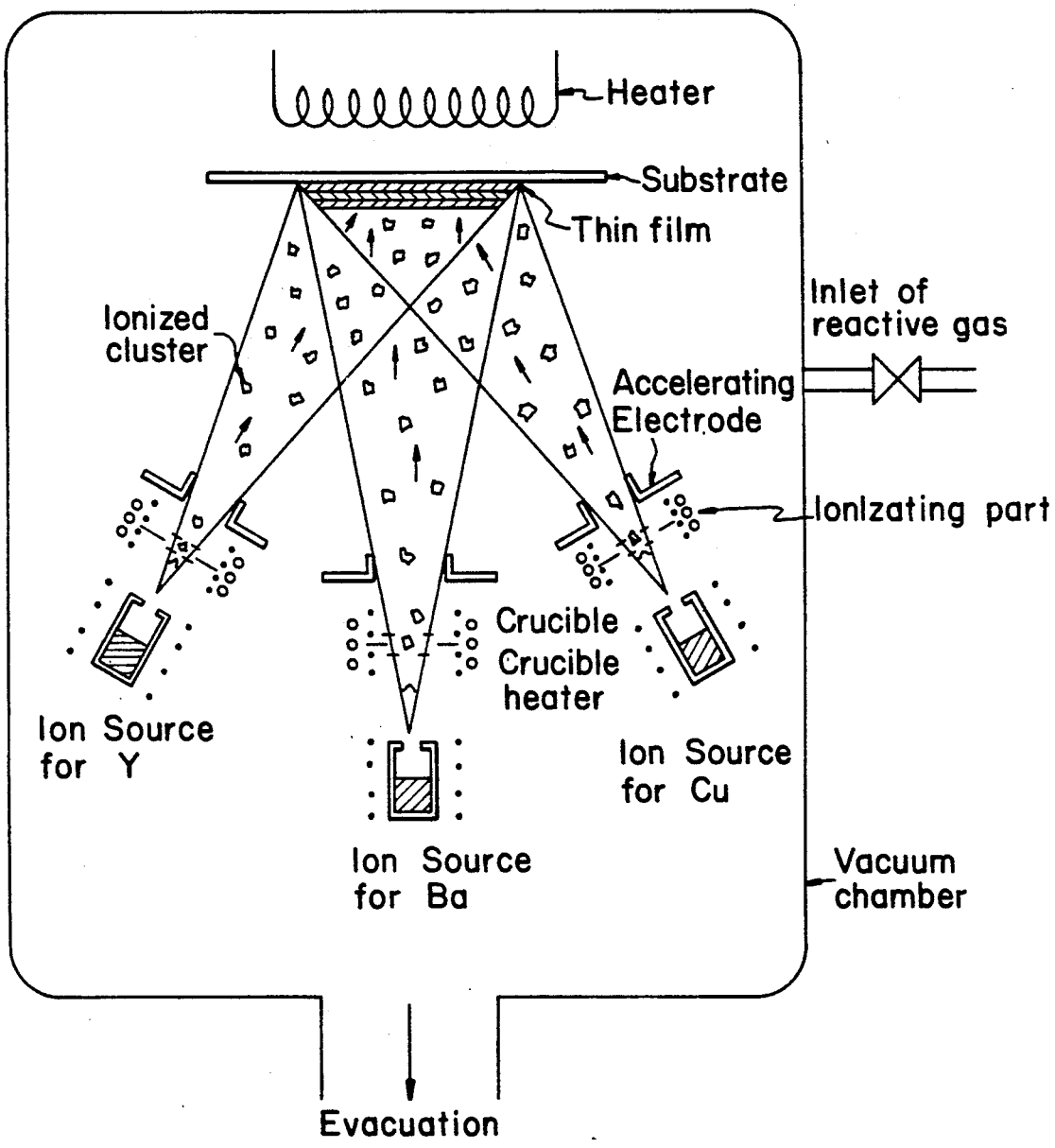
FIG. 7 is a diagrammatic drawing illustrating one apparatus and method for manufacturing antenna systems of this invention.

In manufacturing antenna systems of the invention, the superconductive material may be applied to dielectric substrates by many known methods including laser ablation, sputtering, evaporation, ion cluster beam deposition, metallorganic chemical vapor deposition, various re-crystalization techniques from amorphous or crystaline precursers, or by electrophoresis. An example of one such method is shown in FIG. 7. FIG. 7 shows a three-source, ion cluster beam method of producing superconductive films. Using such a method, a 1000 angstrom film can be formed on a dielectric substrate at 650° F. at a speed of 40 angstroms per minute. In such systems, the deposition takes place in a vacuum chamber containing a heater for the substrate and ion sources for the constituents of the superconductive film. For example, as shown in FIG. 7, the vacuum chamber contains ion sources for yttrium, barium and copper. Each of the ion sources includes a crucible for the elemental materials and a crucible heater. Ion clusters omitted from the crucibles are accelerated by accelerating electrodes and directed onto the heated substrate to form the thin film. Vacuum chamber is provided, as is known in the art, with an inlet for reactive gas, such as oxygen. Methods such as those shown in FIG. 7 can form films having a $J_c$ of about 1,000,000 A-cm$^2$ at 77° K. on a 70 mm diameter area. The multisource simultaneous evaporation method is suitable for producing oxides consisting of many elements.

The antennas, antenna arrays and microwave feed networks and other components of this invention may be cooled below the critical temperature of the superconductive materials by any of a number of cryogenic cooling methods. In addition to planar antenna elements, antenna systems of the invention can include printed slot antenna, and printed dipole elements and other antenna elements in useful phased arrays.

While I have disclosed what I believe to be the best mode and preferred embodiments presently known, other embodiments of the invention will be apparent to those skilled in the art based upon this disclosure and my invention is limited only by the scope of the following claims.

What is claimed is:

1. An antenna apparatus, comprising:

a thin planar layer of high temperature superconductive material formed on one side of a thin, low loss, dielectric substrate, said thin planar layer being patterned to provide a plurality of microwave antenna elements in an array on said dielectric substrate, said thin planar layer of high temperature superconductive material also forming a conductor array on said one side of said thin dielectric substrate, said conductor array comprising a plurality of delay line portions interconnected by a plurality of interconnecting conductor portions leading to said plurality of microwave antenna elements;

a thin continuous planar layer of high temperature superconductive material formed on the other side of said thin dielectric substrate to provide a ground plane;

means to reduce the temperatures of the high temperature superconductive material of said plurality of microwave antenna elements and conductor array and said ground plane below their critical temperature;

said temperature reduction means comprising a cryogenic cooling means, and a closed cryogenic container adapted to maintain temperatures below the critical temperature of said high temperature superconductive material, said cryogenic cooling means being contained in heat transfer relationship with said plurality of antenna elements, said conductor array, and said ground plane;

said closed cryogenic container enclosing said cryogenic cooling means and further comprising a protective covering located over said superconductive plurality of antenna elements and formed by material adapted to pass electromagnetic radiation and provide thermal isolation from the ambient environment;

a plurality of superconductive switching means located at the plurality of interconnecting conductor portions; and means to operate the superconductive switching means located at the plurality of interconnecting conductor portions to raise the temperatures of one or more of the plurality of interconnecting conductor portions above the critical temperature of the high temperature superconductive material and thereby select specific delay line portions and provide variable microwave delays to various antenna elements of the plurality of antenna elements.

2. The antenna apparatus of claim 1 wherein the protective covering is adapted at its outer surface to reflect radiant heat energy and the remainder of said closed cryogenic container forms a vacuum-insulated dewar.

3. The antenna apparatus of claim 1 wherein said superconductive switching means are provided and operated to effectively interrupt microwave radiation from one or more of said antenna elements.

4. The antenna apparatus of claim 1 wherein the plurality of delay line portions each include a plurality of delay sections adapted for variable interconnection by operation of one or more of said superconductive switching means to provide variable beam steering of the antenna apparatus.

5. The antenna apparatus of claim 1 wherein the plurality of antenna elements and the plurality of delay lines are adapted to control the polarization of the energy radiated or received by the antenna apparatus.

6. The antenna apparatus of claim 1 wherein said superconductive material is selected from a group of high temperature superconducting materials consisting of Y-Ba-Cu-O, Er-Ba-Cu-O, thallium based materials and bismuth based materials.

7. The antenna apparatus of claim 1 wherein said dielectric substrate is selected from a group consisting of rare earth gallates and aluminates, magnesium oxide, zirconia, silicon and gallium arsenide.

8. The antenna system of claim 1 wherein said dielectric substrate comprises a ferrimagnetic substrate such as the rare earth orthoferrites.

9. The antenna apparatus of claim 1 wherein said temperature reduction means comprises a closed cycle refrigeration system providing a temperature below the critical temperature, said refrigeration system being integrated with said antenna apparatus and in a heat transfer relationship with said plurality of antenna elements, said conductor array and said ground plane.

10. The antenna apparatus of claim 1 wherein the plurality of delay line portions are interconnected in a phased array by interconnecting conductor portions and wherein each delay line portion is bypassed by a short conductor portion.

11. The antenna apparatus of claim 1 wherein said superconductive switching means comprises:

thin dielectric layers overlying said plurality of interconnecting conductor portions, resistive heating means in heat transfer relationship with said thin dielectric layers and, through said thin dielectric layers, with said plurality of interconnecting conductor portions, and connections for supplying electric current to said resistive heating means.

12. The antenna apparatus of claim 1 wherein said dielectric substrate is selected from a group consisting of rare earth gallates and aluminates, magnesium oxide, zirconia, silicon and gallium arsenide, as layered compositions thereof.

13. An antenna system, comprising:

an array of antenna elements and an array of interconnecting conductors formed by a thin planar layer of high temperature superconductive material on a dielectric substrate, said arrays of antenna elements and interconnecting conductors of high temperature superconductive material being arranged to permit radiation of microwave energy under a plurality of conditions, a ground plane formed by a layer of high temperature superconductive material separated from said antenna elements by said dielectric substrate, means to reduce the temperature of said array of antenna elements, interconnecting conductors and ground plane below the critical temperature of the high temperature superconductive material, said temperature reduction means comprising a cryogenic cooling means, and a closed cryogenic container adapted to maintain temperatures below said critical temperature, said cryogenic cooling means being contained in heat transfer relationship with said antenna elements and said ground plane;

said closed cryogenic container enclosing said cryogenic cooling means and further comprising a protective covering located over said antenna elements formed by material adapted to pass electromagnetic radiation and provide thermal isolation from the ambient environment; and means to increase the temperature of one or more selected portions of the array of interconnecting conductors above the critical temperature of the high temperature superconductive material to thereby change the relative phasing to the array of antenna elements and provide radiation of microwave energy under a second set of conditions.

* * * * *